US007635012B2

(12) United States Patent
Johns et al.

(10) Patent No.: US 7,635,012 B2
(45) Date of Patent: Dec. 22, 2009

(54) SEALED STORAGE CONTAINER WITH A COUPLING ASSEMBLY

(75) Inventors: Garry P. Johns, Mission Viejo, CA (US); Corey N. Johns, Mission Viejo, CA (US); Tim Kuitems, Orange, CA (US)

(73) Assignee: JPro Dairy International, Inc., Mission Viejo, CA (US)

( * ) Notice: Subject to any disclaimer, the term of this patent is extended or adjusted under 35 U.S.C. 154(b) by 446 days.

(21) Appl. No.: 11/451,996

(22) Filed: Jun. 12, 2006

(65) Prior Publication Data

US 2007/0289663 A1 Dec. 20, 2007

(51) Int. Cl.
*B65B 1/04* (2006.01)
*B65D 25/08* (2006.01)

(52) U.S. Cl. ..... 141/322; 141/112; 141/329; 206/222

(58) Field of Classification Search ..... 141/112, 141/322, 329; 206/219, 222
See application file for complete search history.

(56) References Cited

U.S. PATENT DOCUMENTS

| | | | |
|---|---|---|---|
| 2,631,521 | A | 3/1953 | Atkins |
| 2,784,949 | A | 3/1957 | Dennon |
| 2,876,113 | A | 3/1959 | Barton |
| 3,404,811 | A | 10/1968 | Cernel |
| 4,465,183 | A | 8/1984 | Saito et al. |
| 4,757,916 | A | 7/1988 | Goncalves |
| 4,982,875 | A | 1/1991 | Pozzi et al. |
| 4,986,322 | A | 1/1991 | Chibret et al. |
| 5,000,314 | A | 3/1991 | Fuller |
| 5,186,323 | A | 2/1993 | Pfleger |
| 5,209,565 | A | 5/1993 | Goncalves |
| 5,277,303 | A | 1/1994 | Goyet et al. |
| 5,297,696 | A | 3/1994 | Bernstein et al. |
| 5,353,928 | A | 10/1994 | Schumacher |
| 5,366,114 | A | 11/1994 | Bernstein et al. |
| 5,465,835 | A | 11/1995 | Schumacher et al. |
| 5,525,299 | A | 6/1996 | Lowe |
| 5,735,320 | A | 4/1998 | Tune et al. |
| 5,743,423 | A | 4/1998 | Franco |
| 5,782,345 | A | 7/1998 | Guasch et al. |
| 5,927,549 | A | 7/1999 | Wood ..... 426/398 |
| 5,941,380 | A | 8/1999 | Rothman |
| 5,984,141 | A | 11/1999 | Gibler |
| 6,045,254 | A | 4/2000 | Inbar et al. |
| 6,089,389 | A | 7/2000 | Sharon et al. |

(Continued)

FOREIGN PATENT DOCUMENTS

| | | |
|---|---|---|
| EP | 0 692 235 A1 | 1/1996 |

*Primary Examiner*—Timothy L Maust
(74) *Attorney, Agent, or Firm*—Vic Lin; Myers Andras Sherman LLP

(57) ABSTRACT

An initially sealed storage apparatus carrying a material is provided. The present invention is directed to a mixing unit comprising a sealed container joined to a second container. When the second container is fully united with the sealed container, a seal in the sealed container is breached and the contents of the first container and the second container can be mixed. The seal is breached by a bushing enclosed within the sealed container or enclosed in a coupler between the sealed container and the second container which is advanced against the seal, and ruptures the seal when the second container is advanced into the coupler of the coupler portion of the sealed container.

31 Claims, 8 Drawing Sheets

U.S. PATENT DOCUMENTS

| | | | |
|---|---|---|---|
| 6,244,433 | B1 | 6/2001 | Vieu |
| 6,390,342 | B1 | 5/2002 | Mabee |
| 6,485,479 | B1 | 11/2002 | Knierbein |
| 6,517,878 | B2 | 2/2003 | Heczko |
| 6,527,109 | B2 | 3/2003 | Schoo et al. |
| 6,527,110 | B2 | 3/2003 | Moscovitz |
| 6,533,113 | B2 | 3/2003 | Moscovitz |
| 6,540,070 | B1 | 4/2003 | Conwell |
| 6,655,524 | B2 | 12/2003 | De Laforcade |
| 6,668,875 | B2 | 12/2003 | Kojima et al. |
| 6,709,424 | B1 | 3/2004 | Knierbein |
| 6,814,229 | B2 | 11/2004 | Seckler |
| 7,066,323 | B1 | 6/2006 | Reisman |
| 2003/0017236 | A1 | 1/2003 | Makita et al. |
| 2003/0153865 | A1 | 8/2003 | Connell et al. |

SEALED STORAGE CONTAINER WITH A COUPLING ASSEMBLY

CROSS REFERENCE TO RELATED APPLICATIONS

This application is related to co-pending U.S. patent application Ser. Nos. 11/112,931, filed on Apr. 21, 2005 and 11,451,857, filed on Jun. 12, 2006.

FIELD OF THE INVENTION

The present invention is directed to a method and apparatus for sealingly coupling two containers, each holding a different material, to enable the mixture of the different materials.

BACKGROUND OF THE INVENTION

Description of Prior Art and Related Information

Frequently, materials that are to be placed in use, must be compounded or mixed just prior to use because one or both materials are not stable, must be maintained in a sterile environment, are reactive with air and/or water, or the like. Such materials include pharmaceuticals, such as insulin; food products, such as chocolate flavored milk powder; chemical compositions, such as silver salt, hydride salts, and the like; hair dyes; epoxy cements; and the like. These are frequently referred to as two-component compositions. Frequently, one component must be maintained in the sealed state for stability, sterility, or the like. The other component frequently is stable and can be a solvent, such as water, saline solution, or alcohol, propylene glycol, milk, and the like.

Traditionally, two-component compositions are furnished in two separate containers. One or both of the containers may be sealed to maintain its respective contents in a sealed environment. To mix the composition, each sealed container is broken open and its contents are mixed with the other component.

This has never been an ideal situation. One major drawback in this conventional approach consists of the probability of spills. If one of the materials is caustic, or flammable, or extremely reactive, a spill can lead to fire, or the like. If the two components must be mixed in stoichiometric amounts, the loss of a portion of one component can prevent successful mixing and preparation of the desired two-component composition. This is especially true for chemical compositions and a number of pharmaceutical compositions. The transfer of one component to another component also raises the problem of sterility. The air has literally millions of microbes per cubic centimeter. When one component is passed into the container for the other component, or a third container, microbes are carried along into the mixture, contaminating the composition. If either of the components are reactive or sensitive to oxygen, carbon dioxide, water vapor, or air, the mixing has an inherent disadvantage of exposing the component to such materials when blending the two components together.

There is a need for a sealed container which can be opened with minimal exposure to the general environment to permit the mixing of the component from the sealed container with another component without exposing the component in the sealed container to the outside environment.

It is an object of the present invention to provide a sealed container having a coupler which threadingly receives a second container.

It is a further object of the present invention that when the sealed storage container is fully engaged with the second container, the act of fully engaging breaks the seal of the sealed storage container permitting communication between the sealed storage container and the second container.

It is still a further object of the present invention to provide a means of capping a container with a cap assembly containing a sealed container. More particularly it is an object to provide a means of capping a container with a cap assembly having a sealed container, the two containers separated by a rupturable seal within the cap.

It is an even further object of the present invention to provide a cap with sealed container having a large rupturable seal. The seal rupturable when the cap fully engages the container to permit the easy flow of the component from the sealed container in the cap into the container and vice versa.

SUMMARY OF THE INVENTION

The present invention provides structures and methods which overcome the deficiencies in the prior art.

The present invention is directed to a sealed storage container with a coupling assembly for connecting the sealed storage container with a second container.

In one embodiment, the storage container has a coupling assembly for receiving a first container; the storage container comprising a hollow housing having a conduit with first and second open ends and a seal sealing the conduit; the hollow housing having a hollow bushing positioned in the conduit between the seal and the second open end; or a container body having a storage plenum with a first opening; the hollow bushing positioned in the conduit adapted to be advanced toward the first open end of the hollow housing to breach the seal and open communication between the first open end of the hollow housing and the first opening of the container body when the container body is advanced toward the second open end of the hollow housing.

The second open end of the hollow container is adapted to receive a first container. Preferably the conduit and the hollow bushing have a common longitudinal axis.

Preferably the seal is connected by its periphery to the conduit. Preferably the seal is a rigid membrane. In one embodiment, a substantial portion of the periphery of the seal connected to the conduit is sherable by the hollow bushing when it is advanced toward the first open end.

The seal can extend perpendicularly to the longitudinal axis of the conduit, or the seal can extend at an acute angle to the longitudinal axis of the conduit.

The hollow bushing has an open breaching end, and preferably the longitudinal axis of the bushing, the conduit, and the open breaching end having a common longitudinal axis. The open breaching end of the hollow bushing can perpendicular to the longitudinal axis, or the open breaching end of the hollow bushing can be at an acute angle to the longitudinal axis.

In another embodiment, the seal is adapted to be torn around the greater portion of its periphery connected to the bushing when the seal is breached leaving at least a portion of its periphery connected to the hollow bushing. In another embodiment, the seal is adapted to be torn into at least four pie-shaped segments extending from its center to its periphery, the pie-shaped segments at least hinged to the conduit and positioned approximately parallel to the conduit wall as the hollow bushing is advanced through the seal.

Preferably the seal is adapted to be torn into four pie-shaped segments extending from its center to its periphery, the pie-shaped segments at least partially hinged to the conduit and positioned approximately parallel to the conduit wall as the hollow bushing is advanced through the seal.

Preferably the second open end of the hollow housing is threaded to receive the threaded nozzle of a first container. The second open end of the hollow housing is adapted to form a sealing contact with the end of the threaded nozzle of the first container.

Preferably the hollow bushing has an exterior wall and the conduit has an interior wall, the exterior wall of the hollow bushing engaging the interior wall of the conduit in a moveable and sealable relationship.

Preferably the interior wall of the conduit has a circumferential bead in moveable and sealable contact with the exterior wall of the hollow bushing. However, alternatively the exterior wall of the hollow bushing has a circumferential bead in moveable and sealable contact with the interior wall of the conduit.

The storage container can have a second opening. The second opening of the storage container is closed with a closure.

In another embodiment of he present invention, the storage container with a coupling assembly has an end wall opposite the opening of the storage plenum, a body and an outer circumferential wall extending perpendicularly away from the end wall, the inner side being threaded; the hollow housing having an outer wall with an inner side and a conduit wall lining the conduit secured inwardly of the outer wall with a circumferential slot there between, the outer side of the conduit wall threaded to threadedly engage the threaded inner side of the outer circumferential wall of a container to advance the hollow bushing in the conduit to breach the seal across the conduit.

Preferably the inner side of the outer circumferential wall in the slot has a circumferential ratchet ring and the outer side of the outer circumferential wall of the container body has an opposing circumferential ratchet ring so that the container body can be turned in threaded engagement in the hollow body in a first direction to advance the container into the hollow housing to breach the seal, the ratcheted rings in engagement preventing the withdrawal of the container from the hollow body by preventing the turning of the container in the hollow body in a direction reversed to the first direction.

DETAILED DESCRIPTION OF THE PREFERRED EMBODIMENTS

Figure 1:
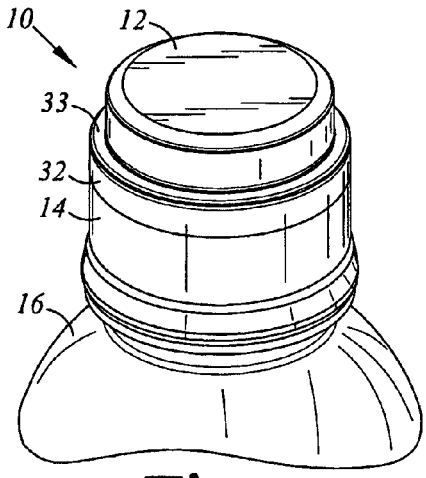
FIG. 1 is a top perspective view of the sealed container with a coupling assembly of the present invention joined to another container.

A first preferred embodiment of a storage apparatus, or sealed apparatus, according to the present invention is shown in FIGS. 1-16 and designated generally by the reference numeral 10. The storage apparatus 10 is also referred to as a sealed apparatus herein since the apparatus 10 is initially, or temporarily, sealed in order to store a first material therein. The storage apparatus 10 is particularly adapted to be coupled to a container, or vessel, to enable the first material held in the apparatus 10 to be mixed with the contents of the vessel.

Figure 2:
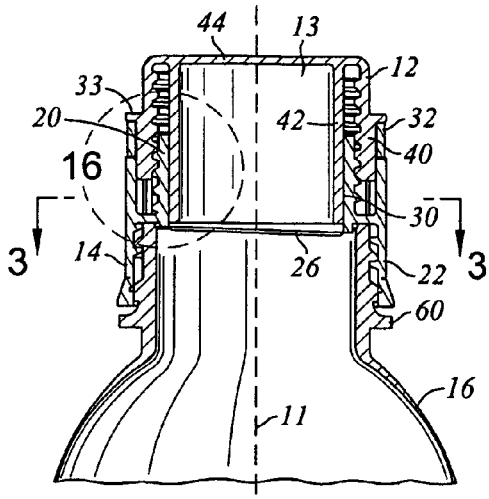
FIG. 2 is a side cross sectional view of FIG. 1.
Figure 3:
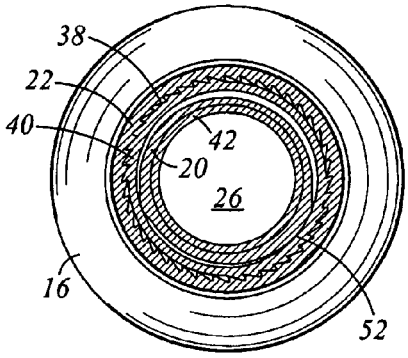
FIG. 3 is a cross sectional along line 3-3 FIG. 2.

The sealed apparatus 10 defines an axis 11, shown in FIG. 2, and comprises a container body 12 and a hollow housing 14. The sealed apparatus 10 can be threadedly engaged with a container, or vessel, 16. The sealed apparatus 10 can function as a cap for the container 16. As examples and not by way of limitation, the container 16 may comprise a variety of bottles and vessels that have a threaded neck, such as drinking water bottles and the like.

Figure 4:
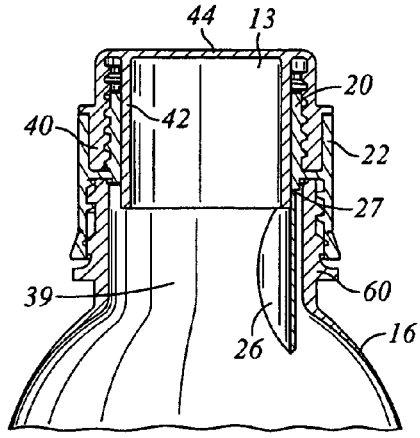
FIG. 4 is a side cross sectional view of the sealed container of FIG. 1 wherein the seal has been breached.
Figure 5:
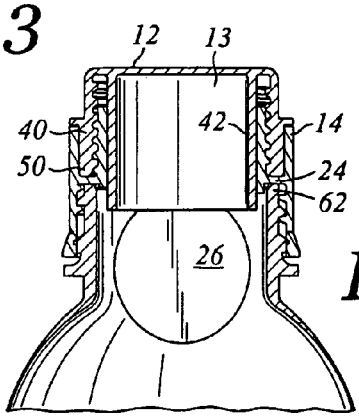
FIG. 5 is another side cross sectional view of the sealed container of FIG. 1 where the seal has been breached.
Figure 6:
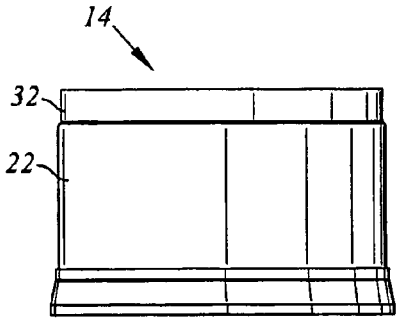
FIG. 6 is a plan side view of the hollow housing of the sealed container with a coupling assembly of FIG. 1.
Figure 7:
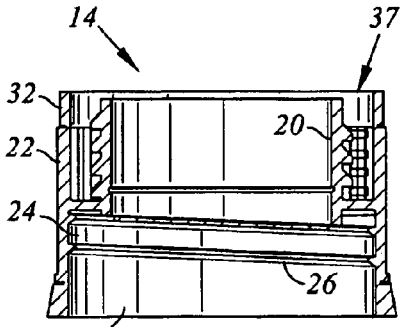
FIG. 7 is side cross sectional view of FIG. 6.
Figure 8:
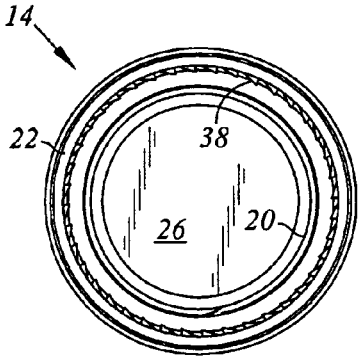
FIG. 8 is a plan top view of FIG. 6.
Figure 9:
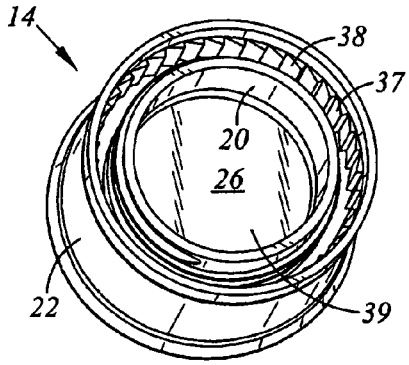
FIG. 9 is a top perspective view of FIG. 6.
Figure 10:
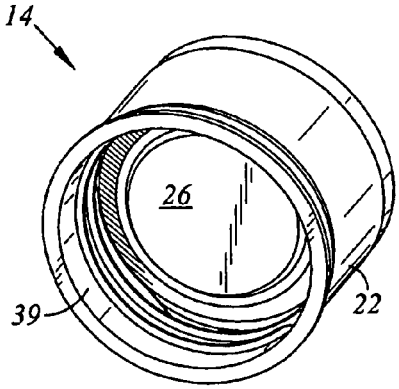
FIG. 10 is a bottom perspective view of FIG. 6.
Figure 11:
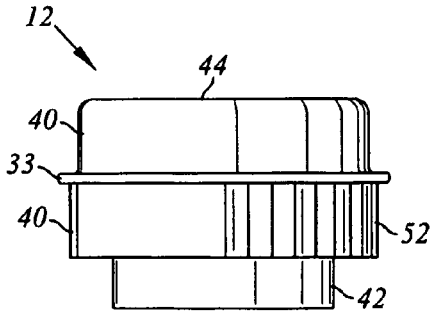
FIG. 11 is a plan side view of the container body of the sealed container with a coupling assembly of FIG. 1.

In FIGS. 2 and 6-10, the hollow housing 14 has an inner annular housing wall 20 and a concentric outer annular housing wall 22. The inner annular wall 20 and outer annular wall 22 are connected by ring wall 24. Ring wall 24 has an upper transverse sealing surface 34 and a lower transverse sealing surface 36 which will be discussed below. In FIGS. 7 and 9, the two annular walls 20, 22 collectively form a channel 37 which is open at the top of the hollow housing 14 and sealed off at the bottom by ring wall 24. The channel 37 is defined by the inner side of the outer annular wall 22 and by the outer side of the inner annular wall 20. As shown in FIGS. 2 and 4, the outer side of the inner annular wall 20 is threaded to receive the container body 12. In FIGS. 2-5, 12 and 16, the channel 37 receives an outer annular wall 40 of the container body 12.

Figure 12:
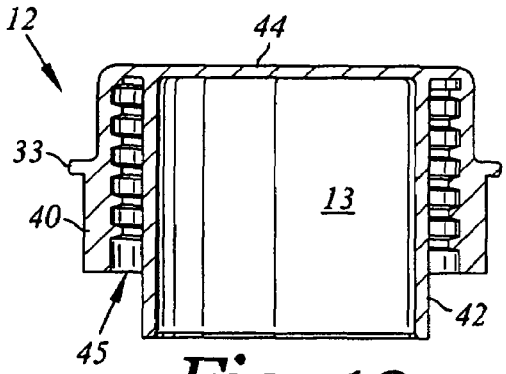
FIG. 12 is a side cross sectional of FIG. 11.

With reference to FIGS. 2 and 11-15, the container body 12 comprises the outer annular wall 40 and a concentric inner annular wall 42 which are joined together by top planar wall 44 of the container body 12. In FIG. 12, a channel 45 is formed between the outer annular wall 40 and the inner annular wall 42 which is open at the bottom and closed off at the top by top wall 44. The channel 45 is defined between the outside of the inner annular wall 42 and the inside of the outer annular wall 40. The inside of the outside annular wall 40 is threaded and adapted to engage the threaded inner annular wall 20 of the hollow housing 12.

Figure 13:
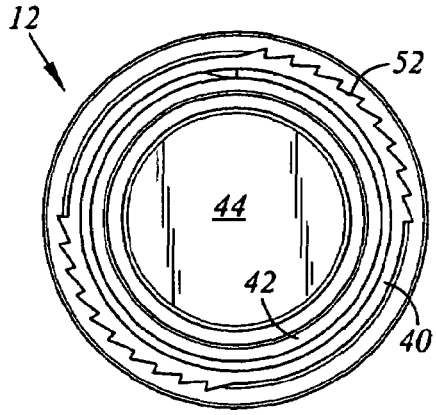
FIG. 13 is a bottom plan view of FIG. 11.
Figure 14:
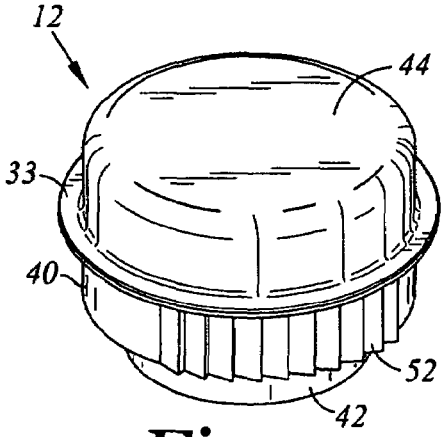
FIG. 14 is a top perspective view of FIG. 11.
Figure 15:
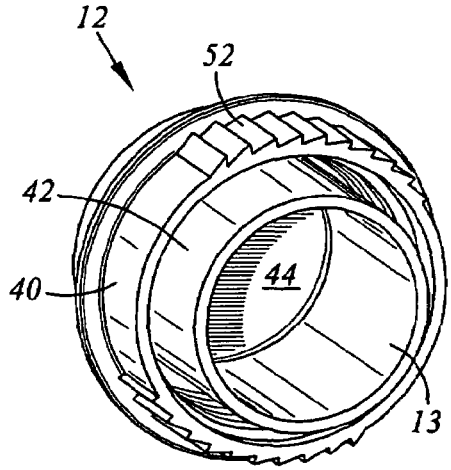
FIG. 15 is a bottom perspective view of FIG. 11.
Figure 16:
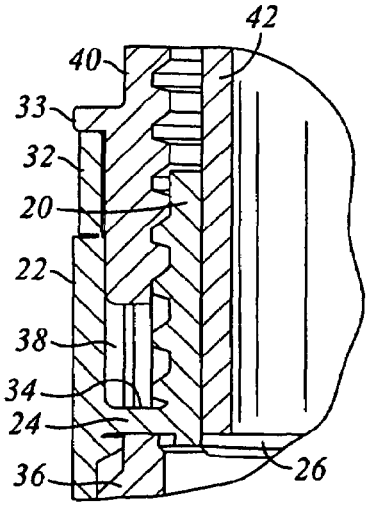
FIG. 16 is an enlarged section take along encircling line 16 of FIG. 2.
Figure 17:
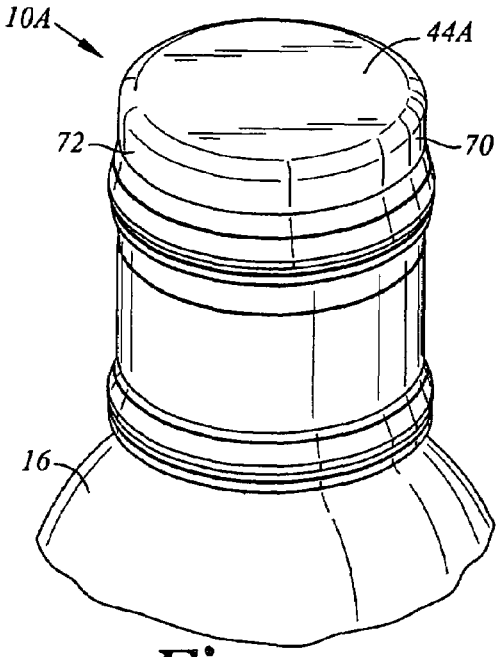
FIG. 17 is top perspective view of another embodiment of the sealed container with a coupling assembly joined to another container.

As shown in FIGS. 13-15, the outside of the outer annular wall 40 of the container body 12 comprises ratchet teeth 52 in opposing sections. These teeth 52 of the body 12 engage the corresponding ratchet teeth 38 in the inside of the outer annular wall 22 of the hollow housing 14 shown in FIG. 9. When the container body 12 is threadedly advanced into the hollow housing 14 by turning the container body 12, clockwise in this case, the body ratchet teeth 52 slide by the housing ratchet teeth 38. However, both sets of ratchet teeth 52, 38 engage and lock when an attempt is made to turn the container body 12 in an opposite direction, counterclockwise in this case, thereby preventing the container body 12 from being threaded out of the hollow housing 14 once it has been advanced. This prevents the container body 12 from being withdrawn from the hollow housing 14 after a seal 26 is breached as described below.

The storage apparatus 10 can be utilized as a cap for a container 16. As shown in FIGS. 2, 4, 5 and 16, the container 16 has a threaded neck 60 which is adapted to threadedly engage the inner threads of the outer annular wall 22 of the hollow housing 14. A top edge 62 of the threaded neck 60 engages the lower transverse sealing surface 36 of the ring wall 24 to seal the storage apparatus 10 onto the container 16. The leading edge of the inner annular wall 42 of the container body 12 is threadedly secured within the hollow housing 14 and positioned against the seal 26.

As shown more clearly in FIGS. 2 and 4, the breakable seal 26 is coupled to the hollow housing 14. The seal 26 is preferably hinged to inner annular wall 42 and configured to be ruptured, or broken, while staying tethered to the inner annular wall at a hinge 27. As shown in FIG. 4, the hinge 27 keeps the ruptured seal 26 connected to the hollow housing 14 so that the seal 26 does not get dislodged and mixed in with the contents of the container 16. The seal 26 positioned at a slight angle from the perpendicular to the longitudinal axis of the storage apparatus 10. This design is preferable since it permits the inner annular wall 42 when advanced toward and through the seal 26 area to make initial contact with a small area of the seal 26 to initiate a tear around the periphery of the seal 26. In FIGS. 1 and 2, as the inner annular wall 42 is advanced further into the hollow housing 14, it propagates the tear about the circumference of the seal 26. In the preferred embodiment, as the inner annular wall 42 is passed through the plane of the seal 26 beyond the hinge area of seal 26, the outside of the inner annular wall 42 forces the seal 26 open (see FIGS. 4 and 5).

When the container body 12 has been fully advanced into the hollow housing 14, the forward edge 50 of the outside annular wall 40 of the container body sealingly abuts the upper transverse sealing surface 34 of the ring wall 24. Thus, the sealed apparatus 10 and the container 16 are in a sealed relationship with respect to each other via the top edge 62 of container 16 engaging the lower transverse sealing surface 36 of the ring wall 24 and the bottom edge 50 of the container body engaging the upper sealing surface 34 of the ring wall 24.

The hollow housing 14 has a tear-away band 32 secured to the top end of the outer annular wall 22 of the hollow housing 14. When the container body 12 is first assembled to the hollow housing 14, the tear-away band 32 and shoulder 33 of the container body 12 prevents the container body 12 from being fully threaded, or screwed, into the hollow housing 14. When the tear-away band 32 is torn away from the outer annular wall 22, space is provided for the container body 12 to be threadedly advanced into the hollow housing 14 to rupture the seal 26 as described above. The combination of the band 32 and the shoulder, or stop, 33 of the container body 12 prevents the container body 12 from being advanced into the hollow housing 14. When the tear-away band 32 is removed, the container body 12 can be threadedly advanced into the hollow housing 14 to the point where the shoulder 33 contacts the upper edge of the outer annular wall 22.

The annular wall 42 forces open and keeps open the seal 26, maintaining the rupture seal 26 roughly parallel to the longitudinal axis 11 of the storage apparatus 10 to furnish a relatively large passageway with minimal hindrance between the plenum 13 of the container body 12, now unsealed, with container 16. This permits the mixing of materials between the two containers. The breached seal is shown in FIGS. 4, 5, 20, 21, and 22. It is advantageous to maintain the seal with the storage container 10 so that when the ingredients or materials between the two containers can be mixed without hindrance of the seal. Thus, the seal is not caught up in the mix, but remains connected to the storage container and positioned not to block the axial passage between the containers.

In the first preferred embodiment, it will be appreciated that the container body 12 is movable with respect to the hollow housing 14 between a first configuratoin, or position, where the seal 26 is intact as shown in FIG. 2, and a second configuration, or position, where the seal 26 is ruptured as shown in FIG. 4. The movement of the container body 12 from the first configuration to the second configuration is accomplished in the first preferred embodiment by simply screwing the container body 12 into the hollow housing 14 after removing the tear-away band 32. In the second configuration, watertight seals are formed between the container body 12 and the hollow housing 14, as well as between the hollow housing 14 and the vessel 16. While ruptured in the second configuration, the seal 26 nonetheless remains partially coupled, or tethered, to the hollow housing 14 so as to not get lost in the mixing of the contents.

An alternative embodiment of the sealed apparatus is illustrated in FIGS. 17-27 and designated generally by the reference numeral 10A. The second preferred apparatus 10A is substantially similar to the first preferred embodiment 10 illustrated in FIGS. 1-16 except that the container body 12 in the first preferred embodiment 10 is replaced with a removable cap 70 and a separate bushing 12A. Alternatively stated, the unitary container body 12 in the first preferred embodiment 10 is substituted by a two-piece container body in the second preferred embodiment 10A comprising a removable cap 70 and a bushing 12A. The removable cap 70 comprises internal threads which engage external threads on the outside annular wall 40A of the bushing 12A. The elements which are common to the first preferred embodiment 10 and the second preferred embodiment 10A have the same element numbers.

The sealed apparatus 10A functions in the same way as the first preferred embodiment 10. The sealed apparatus 10A can be used as a cap for the container 16. The top edge 62 of the threaded neck 60 of the container 16 forms a seal with lower transverse sealing surface 36 of ring wall 24 of the hollow housing 14. The bottom edge 50 of the bushing 12A forms a seal with upper transverse sealing surface 34 when the bushing 12A is fully advanced into hollow housing 14.

When the sealed apparatus 10A is first used to cap off the container 16, the bushing 12A cannot be fully advanced into the hollow housing 14 to breach the seal 26. Its advance is limited by a tear-away band 32 which engages the shoulder 33 of the bushing 12A. When the tear-away band 32 is torn free from the hollow housing 14, the bushing 12A can be threadedly advanced into the hollow housing 14 to rupture and open up the seal 26 to permit the contents within the plenum 13 of the bushing 12A to drop into container 16. This permits the contents of the sealed apparatus 10 to be easily mixed with the contents of the container 16. For example, many hair dyes require that the contents of one container be poured into a second container and stirred or mixed therein to form the activated hair dye. As a further example, epoxy cements require mixing of two components.

Figure 23:
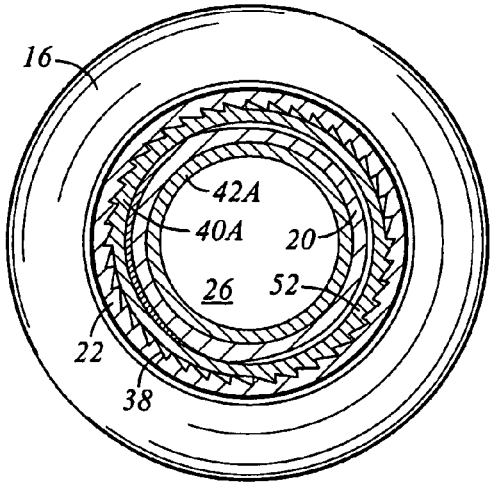
FIG. 23 is a cross sectional view along line 23-23 of FIG. 18.
Figure 24:
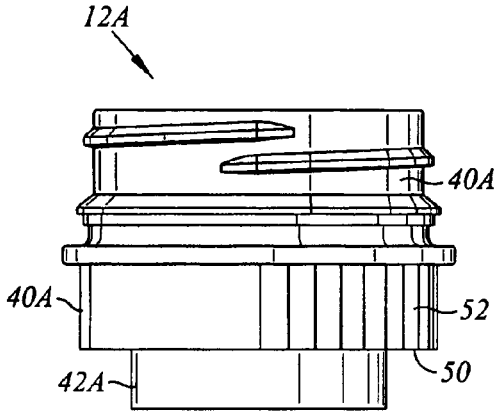
FIG. 24 is a side plan view of the container body of the sealed container with a coupling assembly of FIG. 17.
Figure 25:
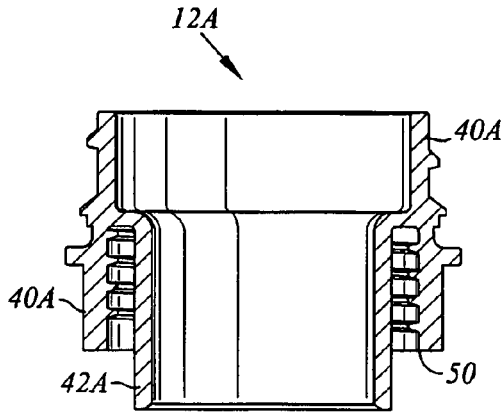
FIG. 25 is a cross sectional view of FIG. 24.
Figure 26:
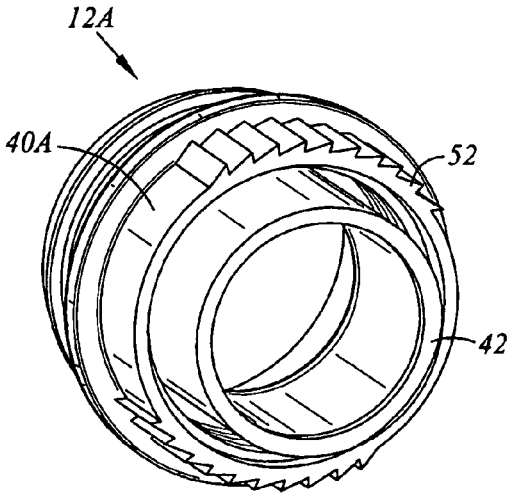
FIG. 26 is a bottom perspective view of FIG. 24.
Figure 27:
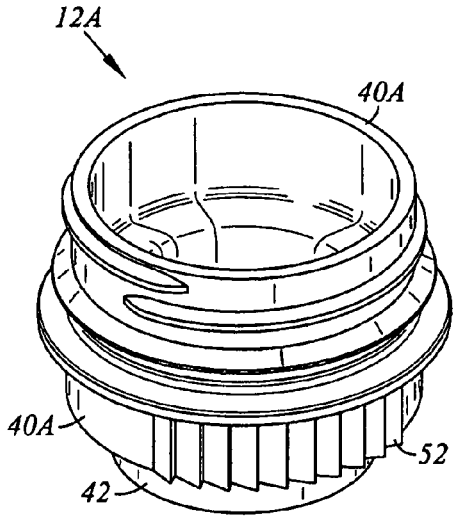
FIG. 27 is a top perspective view of FIG. 24.

To ensure that once the seal is broken and that the sealed apparatus 10A acts as a single unit, the inside of the outer annular wall 22 of the hollow housing 14 is circumferentially lined with a series of ratchet teeth 38. The outside of the outer annular wall 40 has ratchet teeth 52 extending out in opposing sections opposite to each other. The ratchet teeth 52 can be grouped in two sections, three sections, or can be continuous around the outer wall. The sets of teeth 52 and 38 slide by one another when the bushing 12A is advanced into the hollow housing 14 to breach the seal 26. However, any attempt to remove the bushing 12A from the hollow housing 14 by counterrotation will be prevent as the ratchet teeth 52, 38 engage each other and lock as described above with respect to first preferred embodiment 10. Engagement of the teeth 52, 38 is shown in FIG. 23.

When the tear-away band 32 is torn from the hollow housing 14, the container body 12A can be fully threaded into the hollow housing 14 until the shoulder 33 of the bushing 12A engages the top of the outer annular wall 22. As the bushing 12A is threadedly advanced into the hollow housing, the forward end of the inner annular wall 42 engages the seal 26 and ruptures or breaches the seal 26.

In the second preferred embodiment shown, the seal 26 is set at a slight angle off the perpendicular to the longitudinal axial passage. In other words, the seal 26 is not strictly perpendicular to the longitudinal axis of the axial passage of the storage container 10. Preferably the longitudinal axes of the threaded neck of container 16 and the bushing 12A are coaxial. As the inner annular wall 42 is advanced toward the seal 26, it makes contact with the portion of the seal 26 closest to the forward edge of the annular wall 42. As the forward edge engages the seal 26, it forces that portion of the seal 26 in contact with the annular wall 42 toward the container 16 tearing the peripheral edge of the seal 26. As the annular wall 42 is advanced past the seal 26, the periphery of the seal 26 is progressively ruptured around the periphery until all that remains securing the seal to the coupler is hinge.

Figure 18:
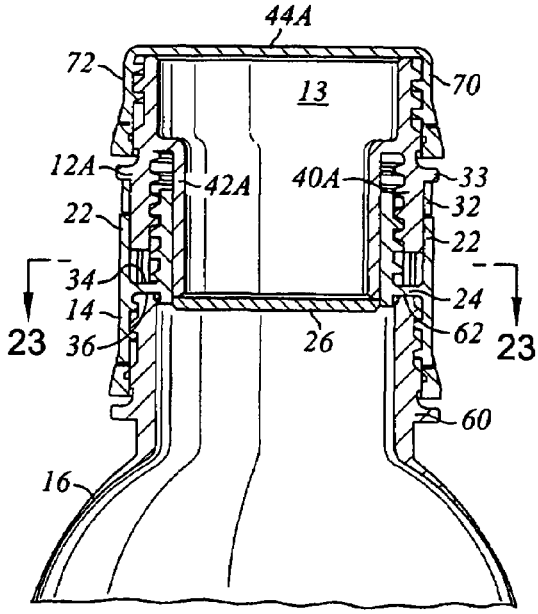
FIG. 18 is a side cross sectional view of FIG. 17.
Figure 19:
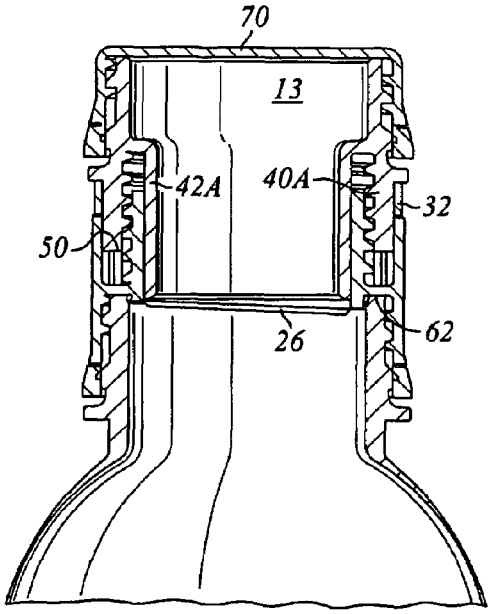
FIG. 19 is a side cross sectional view of FIG. 17 rotated 90° from FIG. 18.
Figure 20:
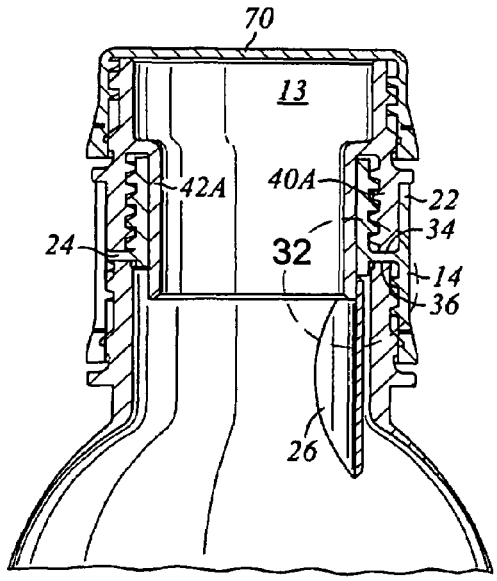
FIG. 20 is a side cross sectional view of FIG. 17 with the seal ruptured.
Figure 21:
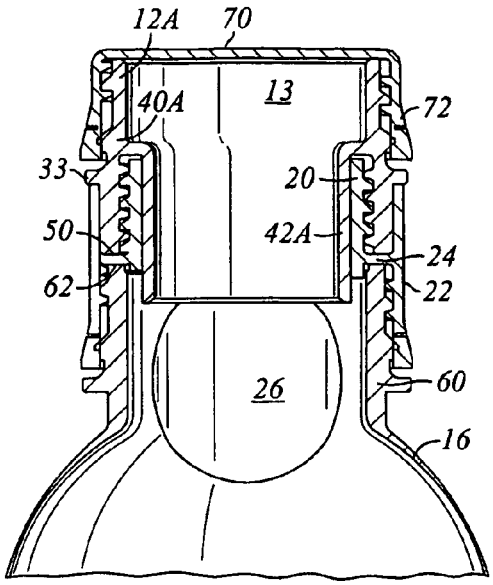
FIG. 21 is a side cross sectional view of FIG. 17 rotated 90° from FIG. 20.
Figure 22:
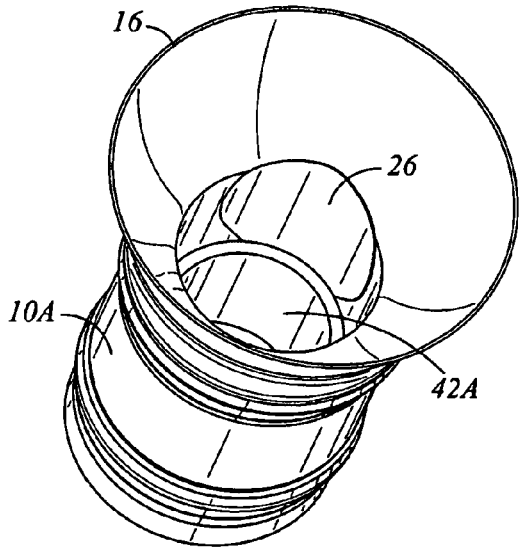
FIG. 22 is a bottom perspective cross sectional view of FIG. 20.

In the second preferred embodiment, it will be appreciated that the bushing 12A is movable with respect to the hollow housing 14 between a first configuratoin, or position, where the seal 26 is intact as shown in FIG. 18, and a second configuration, or position, where the seal 26 is ruptured as shown in FIG. 20. The movement of the bushing 12A from the first configuration to the second configuration is accomplished in the second preferred embodiment by simply screwing the bushing 12A into the hollow housing 14 after removing the tear-away band 32. In the second configuration, watertight seals are formed between the bushing 12A and the hollow housing 14, as well as between the hollow housing 14 and the vessel 16. While ruptured in the second configuration, the seal 26 nonetheless remains partially coupled, or tethered, to the hollow housing 14 so as to not get lost in the mixing of the contents.

In the preferred embodiments of the present invention, when the storage apparatus 10, 10A is supplied apart from the container 16, the bottom open end of the storage apparatus 10, 10A is capped off with a plug, friction fitted or threaded, or with a temporary seal such as a paper seal, foil seal, plastic seal, or the like, to prevent contamination of the axial passageway 39.

Although the invention is described with its specific embodiments, the invention also includes obvious variations of the embodiments described.

Figure 28:
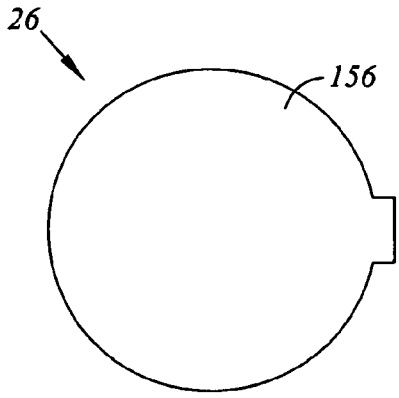
FIG. 28 is a top plan view of a breakable seal comprising a unitary sheet.

Referring to FIGS. 28-31, several embodiments of the breakable seal are shown. In FIG. 28, the breakable seal 26 may comprise a unitary plate, sheet, membrane, or the like. The seal 26 is secured to the coupler or the sealed container as the case may be around the periphery of the seal 26. The seal can be formed with one or more grooves 154A, 154B, 154C, 154D that aid in the rupture or breaching of the seal to permit the seal to be torn into hinged segments. For example, the seal 26A of FIG. 29 would be broken into four segments, or flaps, 156A through 156D. Similarly, the seal 26B of FIG. 30 would be broken up into six segments, or flaps, 156A through 156F. In a similar fashion, the seal 26C of FIG. 31 would be broken up into eight pie-shaped segments, or flaps, 156A through 156H.

Figure 29:
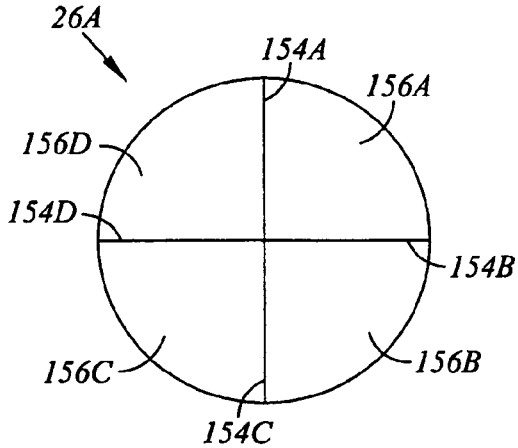
FIG. 29 is a top plan view of an alternate embodiment of a breakable seal comprising four segments.
Figure 30:
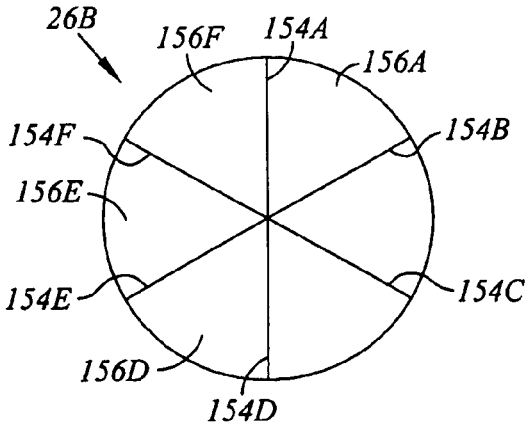
FIG. 30 is a top plan view of an alternate embodiment of a breakable seal comprising six segments.
Figure 31:
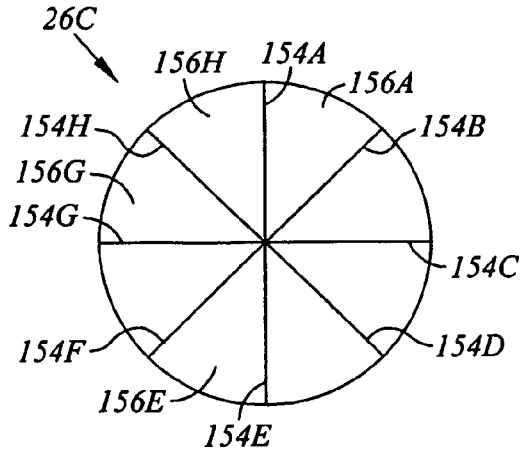
FIG. 31 is a top plan view of an alternate embodiment of a breakable seal comprising eight segments.

Grooves 154 may comprise thinned out portions, such as molded portions, of the seal, or serrated lines to permit the seal to be more easily torn, ruptured, or breached along the groove lines. Each segment, regardless if it is a single segment like the seal 26 shown in FIG. 28 or the four segments shown in FIG. 29, are tied or hinged to the inner annular wall 42 or 42A of the storage apparatus 10 or 10A, respectively. Although four seals are shown which can be divided up into four, six, or eight segments, the breakable seal can be divided up into less or more segments, such as two segments, three segments, five segments, seven segments, twelve segments, and the like.

To aid in the rupture of the seal 26, a portion of the periphery of seal 26 should first be ruptured, torn, or breached and then the remaining periphery of the seal 26 is progressively torn circumferentially, leaving only the hinged portion 27 as shown in FIG. 4. When the seal 26 has more than one segment, the grooves are deliberately made the weakest portion of the seal 26 so that the grooves are breached leaving most of the periphery intact to tie or hinge the segments to the inner annular wall 42, 42A when the seal 26, 26A, 26B, 26C is ruptured. In FIG. 4, the single segment seal 26 is carried by the inner annular wall 42 via hinge 27 connected to the end and/or outer side of the inner annular wall.

A preferred method of assembling two separate containers and mixing the respective contents is also provided according to the invention. In particular, a first material is stored in a first container. The first container is initially sealed with a breakable seal. A second material is held in the second container. The second container may comprise a bottle with a common threaded neck.

Figure 32:
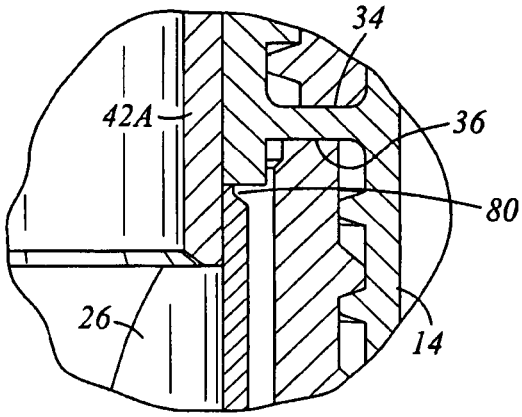
FIG. 32 is a close-up view showing the recessed hinge of the breakable.

FIG. 32 is a close-up view of the recessed hinge 27 of the breakable seal 26. It will be appreciated that the breakable seal 26 is formed with an undercut 80 at the hinge 27 to better facilitate rotation of the seal 26 when ruptured.

Figure 33:
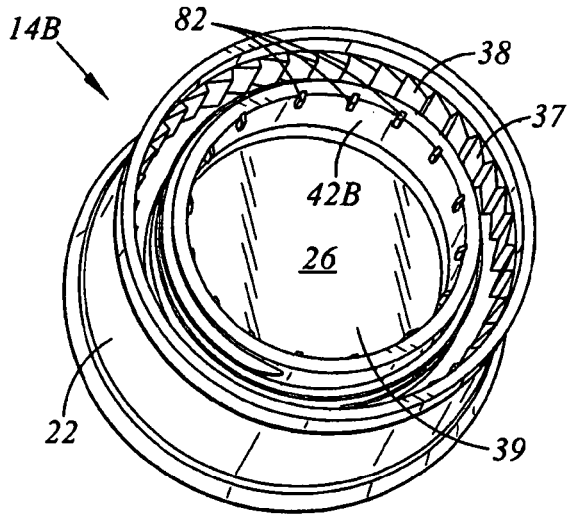
FIG. 33 is a top perspective view of an alternate embodiment of the hollow housing having inner ribs.

FIG. 33 is a top perspective view of an alternate embodiment of a hollow housing 14*b*. The hollow housing 14*b* comprises an inner annular wall 42*b* with inner ribs 82 that protrude downwardly, or outwardly from the bottom, of the inner annular wall 42*b*. Thus, the ribs 82 make initial contact with the breakable seal 26 in the above embodiments and facilitate the rupturing of the seal 26.

Figure 34:
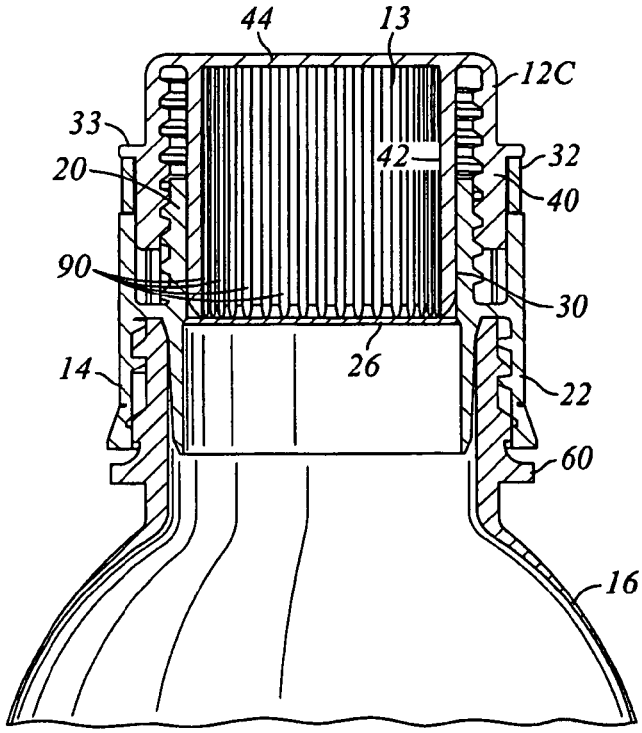
FIG. 34 is a cross-sectional view of an alternate embodiment of a container body having downwardly protruding inner ribs.

FIG. 34 is a cross-sectional view of an alternate embodiment of a container body 12*c* having inner ribs 90 that protrude downwardly. In FIG. 34, the inner ribs 90 protrude downwardly so as to make initial contact with the seal 26 and to apply the penetration force closer to the center of the seal 26.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

The invention claimed is:

1. A storage apparatus for receiving a first container comprising:

a hollow housing having a conduit with first and second open ends and a seal sealing the first open end from the second open end of the conduit;

a container body rotatable with respect to the hollow housing, the container body having a storage plenum within an annular wall, a top enclosed wall and an open end, the open end of the annular wall received within the conduit and adapted to be advanced toward the second open end of the hollow housing to breach the seal and open communication between the second open end of the hollow housing and the first opening of the container body when the container body, the annular wall being configured to remain in a fixed position after being advanced toward the second open end of the hollow housing.

2. The storage apparatus according to claim 1 wherein the second open end is adapted to receive a first container.

3. The storage apparatus according to claim 1 wherein the conduit, and the annular wall have a common longitudinal axis.

4. The storage apparatus according to claim 3 wherein the seal is connected by its periphery to the conduit.

5. The storage apparatus according to claim 4 wherein the seal is a rigid membrane.

6. The storage apparatus according to claim 5 wherein a substantial portion of the periphery of the seal connected to the conduit is shearable by the hollow housing when it is advanced toward the first open end.

7. The storage apparatus according to claim 4 wherein the seal extends perpendicularly to the longitudinal axis of the conduit.

8. The storage apparatus according to claim 4 wherein the seal extends at an acute angle to the longitudinal axis of the conduit.

9. The storage apparatus according to claim 4 wherein the hollow housing has an open breaching end, the longitudinal axis of the annular wall, the conduit, and the second open end having a common longitudinal axis.

10. The storage apparatus according to claim 4 wherein the open end of the hollow housing is perpendicular to the longitudinal axis.

11. The storage apparatus according to claim 4 wherein the open end of the hollow housing is at an acute angle to the longitudinal axis.

12. The storage apparatus according to claim 4 wherein the seal is adapted to be torn around the greater portion of its periphery connected to the bushing when the seal is breached by the open end of the annular wall leaving at least a portion of its periphery connected to the hollow housing.

13. The storage apparatus according to claim 4 wherein the seal is adapted to be torn into at least four pie-shaped segments extending from its center to its periphery, the pie-shaped segments hinged away from the longitudinal axis and positioned approximately parallel to the conduit wall as the open end of the annular wall is advanced through the seal, each pie-shaped segment remaining connected to the bushing.

14. The storage apparatus according to claim 4 wherein the seal is adapted to be torn into four pie-shaped segments extending from its center to its periphery, the pie-shaped segments hinged away from the longitudinal axis and positioned approximately parallel to the conduit wall as the open end of the annular wall is advanced through the seal, each pie-shaped segment remaining connected to the bushing.

15. The storage apparatus according to claim 1 wherein the second open end of the hollow housing is threaded to receive the threaded nozzle of a first container.

16. The storage apparatus according to claim 15 wherein the second open end of the hollow housing is adapted to form a sealing contact with the end of the threaded nozzle of the first container.

17. The storage apparatus according to claim 1 wherein the annular wall has an exterior side and the conduit has an interior wall, the exterior side of the annular wall slidably engaging the interior wall of the conduit in a moveable and sealable relationship.

18. The storage apparatus according to claim 17 wherein the interior wall of the conduit has a circumferential bead in moveable and sealable contact with the exterior wall of the hollow housing.

19. The storage apparatus according to claim 17 wherein the exterior side of the annular wall has a circumferential bead in moveable and sealable contact with the interior wall of the conduit.

20. The storage apparatus according to claim 1 wherein the annular wall is configured to penetrate and remain past a tethered hinge of the seal to maintain the seal in an open position.

21. The storage apparatus according to claim 20 wherein the seal extends substantially parallel to a longitudinal axis of the container when breached.

22. A storage apparatus for receiving a first container comprising:

a hollow housing having a conduit with first and second open ends and a seal sealing the first open end from the second open end of the conduit;

a container body having a storage plenum within an annular wall, a top wall and an open end, the open end of the annular wall received within the conduit and adapted to be advanced toward the second open end of the hollow housing to breach the seal and open communication between the second open end of the hollow housing and the first opening of the container body when the container body wherein the container body has an end wall opposite the opening of a second annular wall around the annular wall and spaced apart therefrom, the top of the second annular wall connected to the top wall, the inner side of the second annular wall being threaded; the hollow housing having an outer wall with an inner side surrounding a portion of and spaced apart from the conduit wall with a circumferential groove between the outer annular wall and the conduit wall, the outer side of the conduit wall threaded and adapted to threadedly engage the threaded inner side of the outer annular wall of the container body to advance the annular wall in the conduit to breach the seal.

23. The storage apparatus according to claim 22 wherein the inner side of the outer annular wall within the groove has a circumferential ring of ratchet teeth and the outer side of the outer annular wall of the container body has opposing sections of ratchet teeth adapted to engage the ring of ratchet teeth of the hollow body to advance the container to permit the container body to be screwed into the hollow housing and to the container body from being screwed out of the hollow housing.

24. A storage apparatus adapted for use in connection with a vessel having a threaded neck, comprising:

a hollow housing configured to mate with the threaded neck of the vessel;

a container body configured to be engaged with, and rotatable with respect to, the hollow housing, the container body comprising a top enclosed wall and a storage plenum for holding a first material;

a breakable seal initially sealing the first material carried in the container body from the vessel, the breakable seal being initially coupled to the hollow housing, wherein the container body is movable with respect to the hollow housing between a first configuration, where the breakable seal is intact, and a second configuration where the container body ruptures the seal to provide fluid communication between the storage plenum and the vessel, the container body being configured to remain fixed in the second configuration.

25. The storage apparatus according to claim 24 wherein the seal is tethered to the hollow housing in the second configuration at a tethered point, and a lower end of the container body is configured to penetrate and remain beyond the tethered point of the seal to maintain the seal in a fully open breached position.

26. The storage apparatus according to claim 24 further comprising a tear-away band to prevent the container body from moving to the second configuration.

27. The storage apparatus according to claim 24 wherein:

the container body comprises a closed top, an outer annular wall, and an inner annular wall; and the hollow housing comprises an outer annular housing wall and an inner annular housing wall.

28. The storage apparatus according to claim 27 wherein the hollow housing further comprises a ring wall disposed between the outer annular housing wall and the inner annular housing wall.

29. The storage apparatus according to claim 24 wherein in the second configuration, the hollow housing forms a seal with the container body.

30. The storage apparatus according to claim 24 wherein the hollow housing forms a seal with the threaded neck of the vessel.

31. The storage apparatus according to claim 24 wherein the breakable seal comprises at least one groove to facilitate the breakable seal being ruptured into multiple segments in the second configuration.

* * * * *